US005959266A

United States Patent [19]

Uchiumi

[11] Patent Number: 5,959,266

[45] Date of Patent: Sep. 28, 1999

[54] ELEVATOR SPEED CONTROL APPARATUS

[75] Inventor: Eiji Uchiumi, Tokyo, Japan

[73] Assignee: Kabushiki Kaisha Toshiba, Kawasaki, Japan

[21] Appl. No.: 09/011,017

[22] PCT Filed: Jun. 12, 1997

[86] PCT No.: PCT/JP97/02036

§ 371 Date: Feb. 5, 1998

§ 102(e) Date: Feb. 5, 1998

[87] PCT Pub. No.: WO97/47551

PCT Pub. Date: Dec. 18, 1997

[30] Foreign Application Priority Data

Jun. 12, 1996 [JP] Japan ..... 8-171608
Nov. 15, 1996 [JP] Japan ..... 8-305123

[51] Int. Cl.[6] ..... B66B 1/34; B66B 1/24

[52] U.S. Cl. ..... 187/292; 187/393; 187/293

[58] Field of Search ..... 187/292, 293, 187/392, 393, 394

[56] References Cited

U.S. PATENT DOCUMENTS 5,635,689 6/1997 Shepard et al. ..... 187/292
5,824,975 10/1998 Hong ..... 187/292

FOREIGN PATENT DOCUMENTS 6-135644 5/1994 Japan .
7-257830 10/1995 Japan .
2271865 4/1994 United Kingdom .

*Primary Examiner*—Robert E. Nappi
*Attorney, Agent, or Firm*—Foley & Lardner

[57] ABSTRACT

The car speed feedback control circuit 1 or 13 calculates the car speed correction signal Vcref2 that can make the car speed detected value Vcfb from the car speed detecting circuit 6 follow-up the car speed command Vcref given from the outside. The speed convert circuit 2 converts the car speed correction signal Vcref2 from the car speed feedback control circuit into the motor speed reference Vmref for the elevator, and the motor speed control circuit 3 controls the rotational speed of the motor according to the motor speed reference from the speed convert circuit. In this feedback control of the elevator according to the car speed, the gain computing circuit 7 computes necessary feedback gains Kd and Tc for suppressing the resonance of the elevator mechanical system based on the combination of the car load detected value mc from the car load detecting circuit 9 and the car position detected value y from the car position detecting circuit 10, and sets the gains for the car speed feedback control circuit. Consequently, it is possible to suppress the vibration that tends to occur when the car reaches to a specific speed caused by the resonance frequency of the elevator mechanical system according to the car load and the car position and improve the passenger comfort.

11 Claims, 10 Drawing Sheets

FIG.2

| CAR LOAD / CAR POSITION | LIGHT | MEDIUM | HEAVY |
|---|---|---|---|
| LOWER FLOORS | $Tc_{11}$ | $Tc_{12}$ | $Tc_{13}$ |
| | $Kd_{11}$ | $Kd_{12}$ | $Kd_{13}$ |
| MEDIUM FLOORS | $Tc_{21}$ | $Tc_{22}$ | $Tc_{23}$ |
| | $Kd_{21}$ | $Kd_{22}$ | $Kd_{23}$ |
| UPPER FLOORS | $Tc_{31}$ | $Tc_{32}$ | $Tc_{33}$ |
| | $Kd_{31}$ | $Kd_{32}$ | $Kd_{33}$ |

ELEVATOR SPEED CONTROL APPARATUS

TECHNICAL FIELD

This invention relates to a speed control apparatus for an elevator car.

BACKGROUND ART

In a roped-elevator, a car connected with a counter weight by a rope travels up and down with a hoist machine winding the rope up and down. A conventional speed control apparatus for the roped-elevator to control the speed of the car is shown in FIG. 8. A speed convert circuit 14 inputs a car speed command value Vcref and converts the car speed command value Vcref to a motor speed reference value Vmref1, where the motor drives the hoist machine. The motor speed reference value Vmref1 is calculated by using constants including a diameter and a rotational angular velocity of a sheave of the hoist machine. A follow-up control circuit 15 inputs a deviation value Vce1 between the motor speed reference Vmref1 and a actual motor speed Vm from a motor speed detecting circuit 5 and calculates a motor speed correction signal Vce2 for the actual motor speed Vm following-up the motor speed reference value Vmref1. This follow-up control circuit 15 is provided with a P (proportional) factor which outputs a signal proportional to the deviation value Vce1 and an I (integral) factor which outputs a signal proportional to a cumulative value of the deviations Vce1.

A motor 16 is a type of an induction motor for driving the elevator. A power from the motor is transmitted to an elevator mechanical system 4 and a car speed Vc changes. Here, the elevator mechanical system 4 represents the whole mechanical system of the elevator including the rope, the car and the counter weight. A resolver is used as the motor speed detecting circuit 5 and it outputs pulses where the number of the pulses per unit time is proportional to its rotational speed.

A vibration suppress circuit 17 in-puts a deviation Vrip (vibration components) between the actual motor speed Vm from the motor speed detecting circuit 5 and a presumed motor speed Vmobs from a motor speed presuming circuit 18 and outputs a compensation component signal Vb against the vibration. FIG. 9 shows an inner schematic structure of the vibration suppress circuit 17. The vibration suppress circuit 17 is provided with a filter circuit 19 for eliminating a vibration component of the motor speed and a gain setting circuit 20 for multiplying the vibration component by a gain to output the vibration compensation signal Vb. The filter circuit 19 defines the most pertinent filter constant based on a car position detected signal y from a car position detecting circuit 10, and passes only a given frequency component in the deviation signal Vrip of the vibration between the actual motor speed Vm and the presumed motor speed Vmobs. The gain setting circuit 20 defines the most pertinent gain based on the car position detected signal y and a car load detected signal mc from a car load detecting circuit 9 and outputs the vibration compensation signal Vb calculated by multiplying an output from the filter circuit 19 by the gain. As set forth above, the vibration suppress circuit 17 calculates the vibration compensation signal Vb for suppressing the vibration caused by the changes of the car position and the car load and adds the signal Vb on a motor speed correction signal Vce2 outputted from the follow-up control circuit 15. As a result, the added signal (Vce2−Vb) is inputted as a motor speed reference value Vmref2 to the motor 16 and the motor 16 can rotate smoothly without vibrations.

Here, the car position detecting circuit 10 includes a pulse generator mounted on a governor and evaluates the car position from the number of the pulses generated proportionally to a distance of movement of the car. The car load detecting circuit 9 includes a load cell (or a linear-former) mounted under the floor of the car and outputs a voltage signal proportional to the car load. The detecting circuits 9 and 10 input their output signals mc and y into the vibration suppress circuit 17.

Another follow-up control circuit 21 calculates, based on a deviation signal Vmobs1 between the motor speed reference value Vmref1 from the speed convert circuit 14 and the presumed motor speed Vmobs, the target speed correction signal Vmobs2 of the motor that can make the presumed motor speed Vmobs follow-up the motor speed reference Vmobs. A motor speed presuming circuit 18 includes an approximate model of the motor which simulates an action of the motor 16 and presumes the rotational speed Vmobs thereof by means of an inertia moment of a model of an elevator mechanical system 22 when the model operates at the presumed speed Vmobs. Here, the model of the elevator mechanical system 22 is the approximate model of the elevator mechanical system 4.

The convenient speed control apparatus for elevator constructed as set forth above acts in the following manner. The speed convert circuit 14 inputs the car speed command value Vcref and converts it to the motor speed reference value Vmref1. The follow-up control circuit 15 inputs the deviation value Vce1 between the motor speed reference value Vmref1 from the speed convert circuit 14 and the detected motor speed Vm from the motor speed detecting circuit 5 and carries out a PI control calculation based on the deviation signal Vce1 to output the target value correction signal Vce2. The motor 16 inputs the deviation between the target value correction signal Vce2 from the follow-up control circuit 15 and the vibration compensation signal Vb from the vibration suppress circuit 17 as the motor speed reference Vmref2, and rotates so as to follow-up the speed reference Vmref2. The driving force of the motor is transmitted to the elevator mechanical system 4 so that the car of the elevator travels at a speed Vc. The car load mc and the position y of the car are detected respectively by the car load detecting circuit 9 and the car position detecting circuit 10 and inputted to the vibration suppress circuit 17.

The motor speed reference Vmref1 from the speed convert circuit 14 is also inputted to another follow-up control circuit 21. The follow-up control circuit 21 carries out the PI control calculation based on the deviation Vmobs between the motor speed reference Vmref1 and the presumed motor speed Vmobs from the motor speed presuming circuit 18 to gain the target value correction signal Vmobs and inputs it to the motor speed presuming circuit 18. The motor speed presuming circuit 18 calculates, based on the inputted target value correction signal Vmobs2, the presumed motor speed Vmobs that can suppress the vibration of the car and outputs to the mechanical system model 22 of the elevator. The elevator mechanical system model 22 calculates the inertia moment J when this model operates at the presumed speed Vmobs, and inputs the inertia moment J to the motor speed presuming circuit 18.

The vibration suppress circuit 17 inputs the deviation between the actual motor speed Vm from the motor speed detecting circuit 5 and the presumed motor speed Vmobs from the motor speed presuming circuit 18 as the vibration component Vrip and also inputs the car load detected value mc from the car load detecting circuit 9 and the car position detected value y from the car position detecting circuit 10.

Further, the vibration suppress circuit 17 calculates, based on these inputs, the vibration compensation signal Vb by means of the manner set forth above. The motor 16 inputs the deviation between the motor speed target value Vce2 from the follow-up control circuit 15 and this vibration compensation signal Vb as the motor speed reference Vmref2 in order that the rotational speed of the motor follows-up the command value Vref2.

As set forth above, based on the changes of the position and load of the car, the vibration compensation signal Vb for suppressing the vibration is calculated, and thereto the motor speed correction signal Vce2 outputted from the follow-up control circuit 15 is added. The motor rotates at a speed following-up the motor speed reference Vmref2, which is the value of the added signal (Vce2-Vb), so that the vibration of the car is suppressed.

However, there have been several drawbacks as below in the speed control apparatus for elevator of the prior art. FIG. 10 shows frequency characteristic curves of the elevator mechanical system 4 corresponding to the changes of the car load. The car load is divided into three levels 'heavy', 'medium' and 'light', and the three curves respectively correspond to these three levels. In FIG. 10, the horizontal axis indicates the angular velocity of the sheave (corresponding to the rotational speed of the motor 16) and the vertical axis indicates a gain of the elevator mechanical system 4 derived between the car speed command Vcref inputted from the speed convert circuit 14 and the car speed Vc outputted from the system shown in FIG. 8. As shown in FIG. 10, the car speed Vc causing the resonance in the elevator mechanical system 4 differs according to the levels of the car load.

However, in the vibration suppress circuit 17 of the prior art shown in FIG. 10, the car load detected value mc is inputted only to the gain setting circuit 20, and it is not inputted to the filter circuit 19. Namely, the filter circuit 19 refers to the changes of the characteristic caused by the changes of the car position but does not refer to the changes of the characteristic caused by the changes of the car load. Accordingly, the speed control apparatus of the prior art can not effectively suppress the vibration generated at a specific car load caused by the changes of the car load within a range of operation speed such as 20–30 [rad/s] range of the angular velocity of the sheave, so passenger comfort is diminished.

DISCLOSURE OF INVENTION

The object of this invention is to solve the drawbacks of the prior art set forth above and to provide a speed control apparatus for an elevator which can precisely control the car speed withstanding the changes of the car load as well as the changes of the car position and improve the passenger comfort.

To achieve this object, the speed control apparatus for elevator of this invention comprises:

- a car speed detecting circuit for detecting a car speed;
- a car load detecting circuit for detecting a car load;
- a car position detecting circuit for detecting a car position;
- a car speed feedback control circuit for inputting a deviation between a car speed command value given from an outside and a car speed detected value from the car speed detecting circuit and for calculating a car speed correction signal required for an actual car speed to follow-up the car speed command value;
- a speed convert circuit for converting the car speed correction signal calculated by the feedback control circuit into a motor speed reference signal of the elevator;
- a motor speed control circuit for controlling a speed of a motor which drives the elevator based on the motor speed reference signal outputted from the speed convert circuit; and
- a vibration component compensation circuit for eliminating from the car speed detected value a resonance frequency component of an elevator mechanical system corresponding to a combination of the car load detected value from the car load detecting circuit and the car position detected value from the car position detecting circuit and for outputting the resonance frequency component as a vibration compensation signal to suppress the resonance frequency component contained in the car speed correction signal.

In addition, in the speed control apparatus for elevator of this invention set forth above, it is preferable that the vibration component compensation circuit comprises:

- a filter constant and gain computing circuit for calculating a filter constant and a gain corresponding to the combination of the car load detected value from the car load detecting circuit and the car position detected value from the car position detecting circuit;
- a filter for setting a pass frequency based on the filter constant from the filter constant and gain computing circuit and for passing the resonance frequency component of the elevator mechanical system contained in the car speed detected value; and
- a gain setting circuit for multiplying the resonance frequency component of the elevator mechanical system outputted from the filter by the gain from the filter constant and gain computing circuit and for outputting a result thereof as the vibration compensation signal to suppress the resonance frequency component contained in the car speed correction signal.

In this invention of the speed control apparatus for elevator, the car speed feedback control circuit calculates, based on the deviation between the command value of the car speed and the car speed detected value by the car speed detecting circuit, the speed correction signal required for the actual car speed to follow-up the car speed command value given from the outside, the speed convert circuit converts the car speed correction signal calculated by the feedback control circuit into the motor speed reference signal of the elevator, and the motor speed control circuit controls the speed of the motor for driving the elevator based on the motor speed reference signal from the speed convert circuit.

Further, in this feedback control of the elevator speed based on the car speed, the vibration component compensation circuit eliminates from the car speed detected value the resonance frequency component of the elevator mechanical system corresponding to the combination of the car load detected value from the car load detecting circuit and the car position detected value from the car position detecting circuit and outputs the resonance frequency component as the vibration compensation signal in order to suppress the resonance frequency component contained in the car speed correction signal.

As a result, the car speed feedback control circuit can output the car speed correction signal to the speed convert circuit as a signal without the resonance frequency component, and this speed convert circuit also can output the motor speed reference value as a signal without the resonance frequency component of the elevator mechanical system for the sake of the motor speed control. Consequently, it can effectively suppress the vibration generated at the specific car speed in accordance with the resonance frequency of the elevator mechanical system which uninterruptedly changes depending on the car load and the car position and improve the passenger comfort.

Further, in the speed control apparatus for elevator of this invention, by constructing the vibration component compensation circuit with the filter constant and gain computing circuit for calculating the filter constant and the gain corresponding to the combination of the car load detected value from the car load detecting circuit and the car position detected value from the car position detecting circuit, the filter for setting the pass frequency based on the filter constant from the filter constant and gain computing circuit and for passing the resonance frequency component of the elevator mechanical system contained in the car speed detected value, and the gain setting circuit for multiplying the resonance frequency component of the elevator mechanical system outputted from the filter by the gain from the filter constant and gain computing circuit and for outputting the result thereof as the vibration compensation signal to suppress the resonance frequency component contained in the car speed correction signal, it can eliminate the resonance frequency component of the elevator mechanical system which appears in the car speed detected value, gain the vibration compensation signal by multiplying this resonance frequency component by the pertinent gains, and add this vibration compensation signal on the car speed correction signal so as to suppress the resonance frequency component contained therein. As a result, it can input the car speed correction signal to the speed convert circuit as a signal without the resonance frequency component from the car speed feedback control circuit, and this speed convert circuit also can output the motor speed reference value as a signal without the resonance frequency component of the elevator mechanical system for the sake of the motor speed control. Accordingly, it can effectively suppress the vibration of the car and improve the passenger comfort.

BRIEF DESCRIPTION OF DRAWINGS

FIG. 2 is a data table of filter constants and gains to which a filter constant and gain computing circuit refers for setting a filter constant and gain according to the first embodiment of this invention.

BEST MODE FOR CARRYING OUT THE INVENTION

Figure 1:
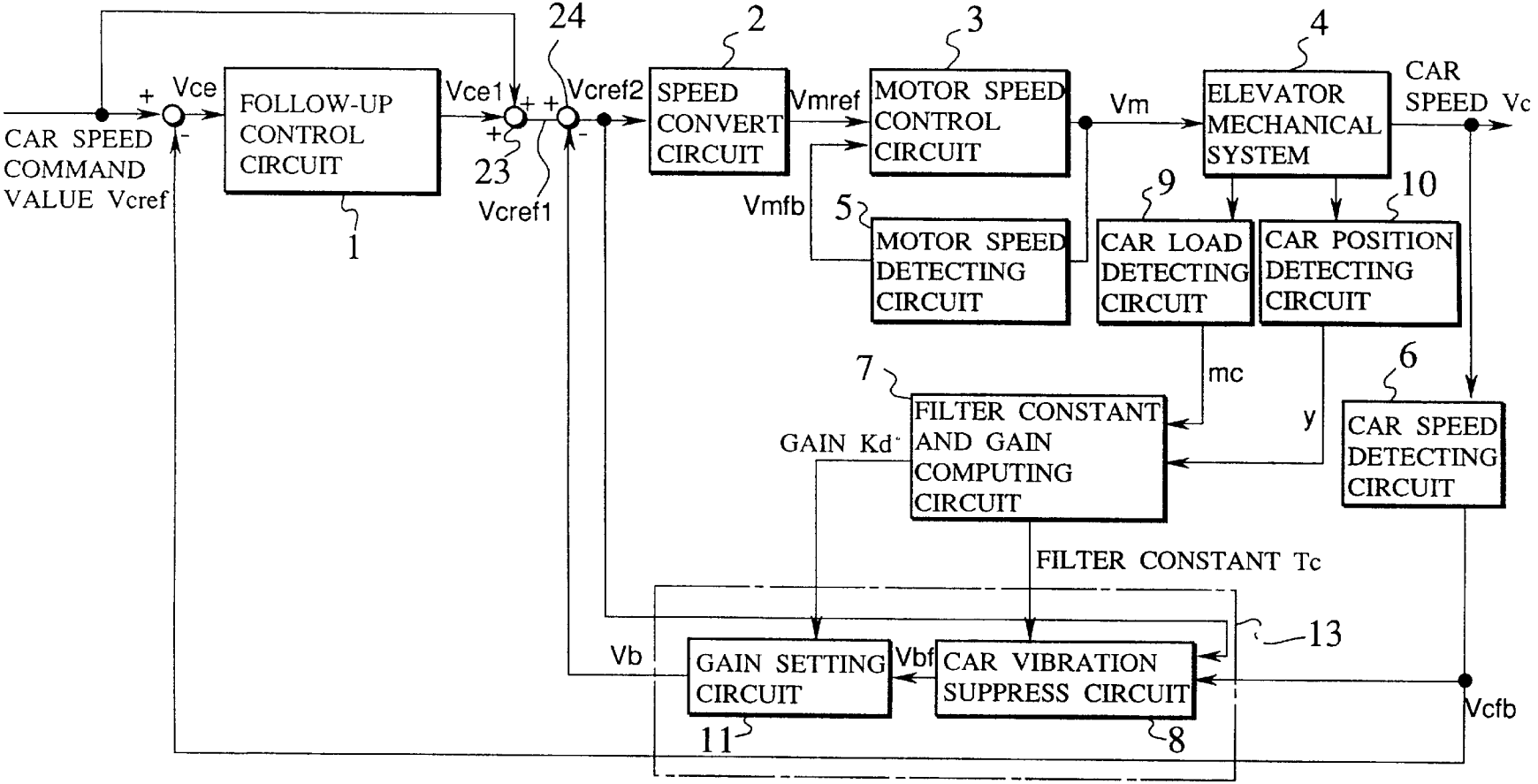
FIG. 1 is a schematic diagram of a first embodiment of a speed control apparatus for an elevator of this invention.

A first of preferred embodiments of this invention will be explained referring to FIGS. 1–3 hereinbelow. The first embodiment of a speed control apparatus for an elevator is provided with a follow-up control circuit 1, a speed convert circuit 2, a motor speed control circuit 3, an elevator mechanical system 4, a motor speed detecting circuit 5, a car speed detecting circuit 6, a filter constant and gain computing circuit 7, a car load detecting circuit 9, a car position detecting circuit 10 and a vibration suppress circuit 13. Further, the vibration suppress circuit 13 is provided with a car vibration suppress circuit 8 and a gain setting circuit 11.

The follow-up control circuit 1 inputs a deviation Vce between a car speed command value Vcref given from the outside and a car speed detected value Vcfb from a car speed detecting circuit 6 to calculate a car speed correction signal Vce1 which is necessary for a actual car speed to follow-up the car speed command value Vcref. Several methods have been used as a follow-up control in the follow-up control circuit 1, and in this embodiment a PI control as equation (1) is used because of its structural simplicity and arithmetical easiness. In equation (1), Tr1 and Tr2 are regulating parameters.

$$Vce1 = \frac{1 + Tr2 \cdot s}{Tr1 \cdot s} \cdot Vce \tag{1}$$

The car speed correction signal Vce1 outputted from the follow-up control circuit 1 is added on the car speed command value Vcref for correction thereof at an adder 23. A car speed reference value Vcref1 from the adder 23 is added by an adder 24 on a vibration compensation signal Vb from the vibration suppress circuit 13 and the result value is outputted as a car speed reference Vcref2 to the speed convert circuit 2.

The speed convert circuit 2 converts the car speed reference Vcref2 to a motor speed reference Vmref by using constants including a sheave diameter and an rotational angular velocity of the elevator mechanical system 4. Equation (2) is an arithmetic equation carried out in the speed convert circuit 2, where Kmc is a proportional constant indicating a ratio of a actual car speed Vc to a motor speed Vm and it is univocally definable based on a characteristic of the elevator mechanical system 4.

$$\text{Vmref} = Km \cdot \text{Vcref2} \tag{2}$$

The motor speed control circuit 3 is provided with a motor for driving the elevator and a PI control system, and controls the motor speed Vm to follow-up the target value Vmref by means of feeding-back a motor speed detected value Vmfb from the motor speed detecting circuit 5.

The elevator mechanical system 4 is a controlled system by this speed control apparatus and the system 4 represents the whole mechanical apparatus including a rope, a car and a counter weight. Therefore, the car of the elevator mechanical system 4 results in to travel at the speed Vc corresponding to the motor speed Vm controlled by the motor speed control circuit 3.

The motor speed detecting circuit 5 is provided for detecting the motor speed Vm, and a resolver directly mounted on a motor shaft thereof is used to detect the motor speed and the number of output pulses per unit time from the resolver is converted into the motor speed Vm. Similarly, the car speed detecting circuit 6 is provided for detecting the car speed Vc, and a pulse generator or a tape wheel mounted on a governor thereof is used to detect the car speed and the number of output pulses per unit time from the pulse generator is converted into the car speed Vc.

The filter constant and gain computing circuit 7 selects a filter constant Tc and a gain Kd, that can reduce an influence caused by a change of an elevator performance, suitably corresponding to a car load detected value mc from the car load detecting circuit 9 and a car position detected value y from the car position detecting circuit 9 by referring to a table data provided therein. FIG. 2 shows the data table to which the filter constant and gain computing circuit 7 refers.

Changes of the car positions are ranked in three columns and changes of the car loads are ranked also in three rows, and total nine combinations between the filter constants and the gains are listed in the data table as illustrated in FIG. 2, where Tc11–Tc33 represent the filter constants and Kd11–Kd33 represent the gains. Each combination of the constant and the gain is used as parameters corresponding to a resonance frequency of the elevator mechanical system which differs by each rank. These filter constants and gains are defined through a simulation of each machine and, if necessary, are adjusted by test runs. The filter constant and gain computing circuit 7 refers to the data table and reads out the filter constant and the gain listed in the corresponding column and row to the car load detected value mc and the car position detected value y and gives the filter constant selected to the car vibration suppress circuit 8 and the gain selected to the gain setting circuit 11 in the vibration suppress circuit 13. It is noted that an average value among several values detected immediately before an actual run is used as the car load detected value mc, here.

In the roped elevator, it has been a big problem for improving the performance of the elevator control because a spring constant uninterruptedly changes according to changes of the car loads and changes of the rope length that are caused by changes of the number of passengers. However, this invention has made it possible to compensate the changes of the car load and the spring constant by employing the filter constant and gain computing circuit 7 as well as the vibration suppress circuit 13.

Figure 3:
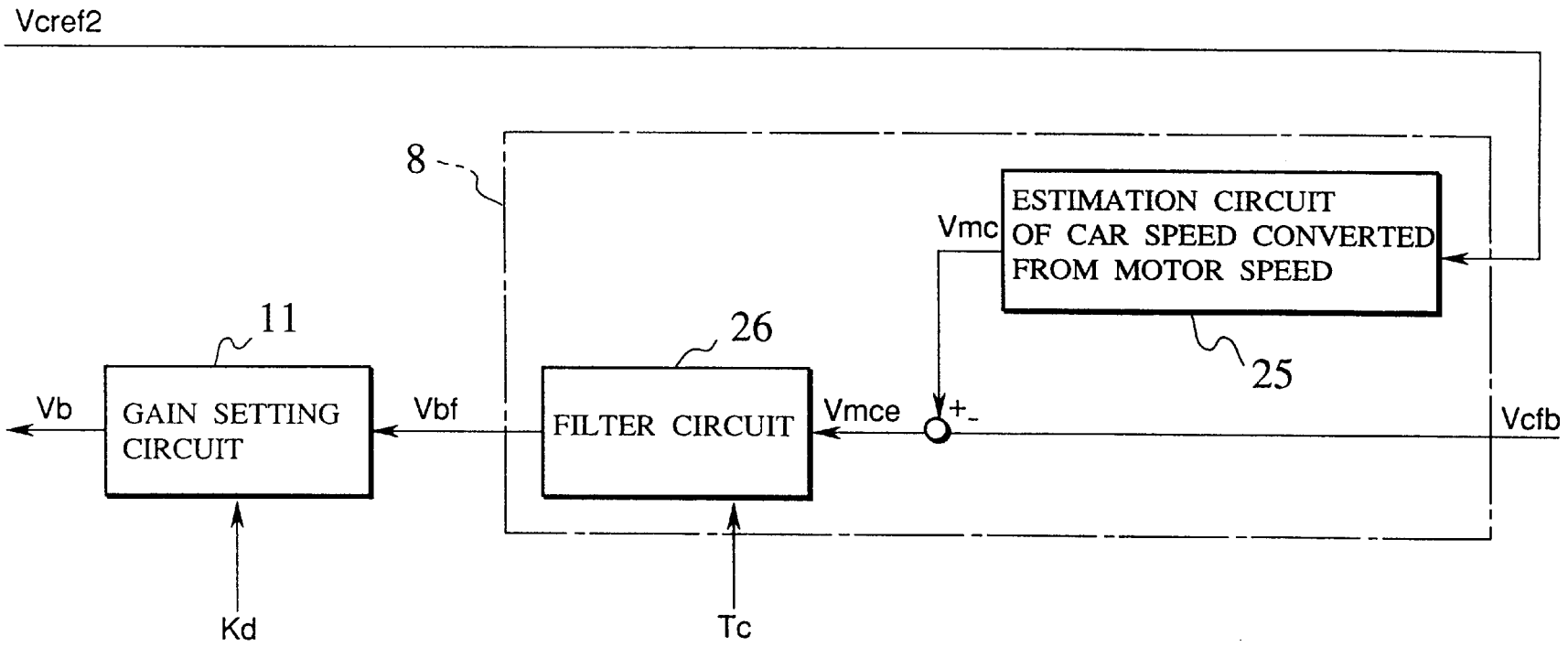
FIG. 3 is a block diagram of a vibration suppress circuit according to the first embodiment.
Figure 4:
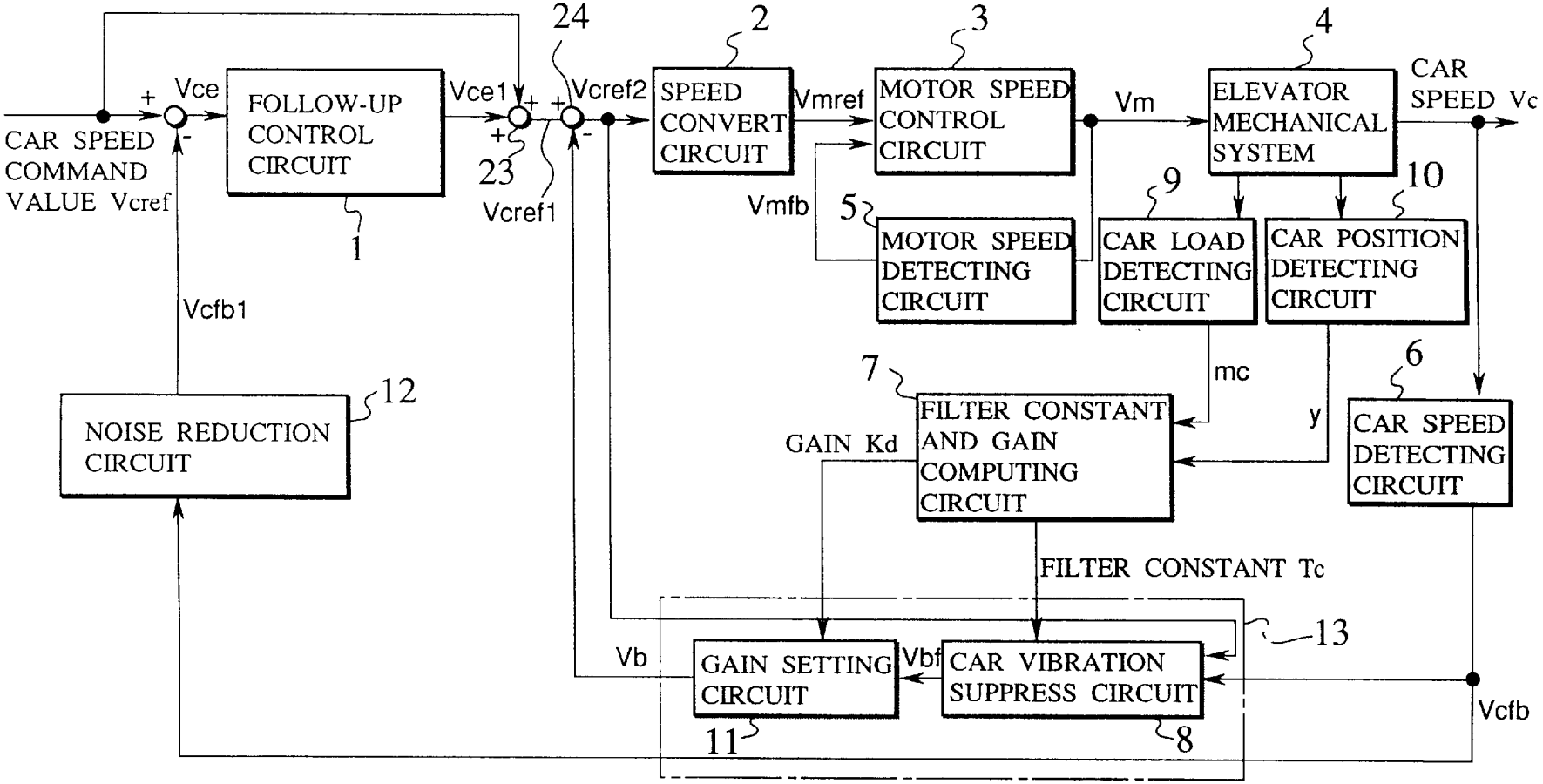
FIG. 4 is a schematic diagram of a second embodiment of a speed control apparatus for an elevator of this invention.

As shown in FIG. 3, the vibration suppress circuit 13 is provided with the car vibration suppress circuit 8 and the gain setting circuit 11. The vibration suppress circuit 13 inputs the car speed reference value Vcref2, the car speed detected value Vcfb, and the filter constant Tc and the gain Kd from the filter constant and gain computing circuit 7 n order to calculate the vibration compensation signal Vb for suppressing the car vibration and to correct the car speed reference Vcref2.

When evaluate the deviation between the actual car speed Vc and the target value thereof, it is necessary to take a delay within the motor into account. In this first embodiment, therefore, the vibration suppress circuit 13 is arranged as shown in FIG. 3 for calculating the vibration compensation signal Vb wherein the car vibration suppress circuit 8 is provided with an estimation circuit of car speed converted from motor speed 25 and a filter circuit 26.

First, the estimation circuit of car speed converted from motor speed 25 calculates an estimation value of car speed Vmc converted from motor speed by using the car speed reference value Vcref2. Though various estimation methods are applicable to this estimation circuit of car speed converted from motor speed 25, the following equation (3) is used in this first embodiment because a response of the actual motor tends to delay by first order and the structure thereof is simple. In equation (3), Tm is a regulating parameter and it is defined according to charts of the actual machine or numerical simulations.

$$Vmc = \frac{1}{1 + Tm \cdot s} \cdot Vcref2 \tag{3}$$

Subsequently, the filter circuit 26 and the gain setting circuit 11 calculate the vibration compensation signal Vb by using a deviation Vmce between the estimation value of car speed Vmc converted from motor speed and the car speed detected value Vcfb. Since it is necessary to eliminate the resonance frequency component alone for suppressing the car vibration, the filter circuit 26 is essential. The filter circuit 26 reduces high-frequency noises contained in the car speed detected value Vcfb, and outputs the designated frequency component as a compensation signal Vbf contained in the deviation Vmce between the estimation value of car speed Vmc converted from motor speed and the car speed detected value Vcfb. The gain setting circuit 11 multiplies the compensation signal Vbf from the filter circuit 26 by the gain Kd to output the vibration compensation signal Vb. Consequently, the vibration compensation signal Vb is the same signal with that of being outputted from a band-pass filter with a characteristic expressed by equation (4), wherein the deviation Vmce between the estimation value of car speed Vmc and the car speed detected $$Vb = \frac{Kd \cdot s}{(1 + Tc \cdot s)^2} \cdot Vmce \tag{4}$$

where, Kd is a regulating gain and Tc is the regulating parameter, and the values selected by the filter constant and gain computing circuit 7 are used for these values.

The speed control apparatus for elevator of the first embodiment constituted as set forth above acts as below. The follow-up control circuit 1 inputs the car speed deviation Vce between the car speed command value Vcref and the car speed detected value Vcfb and calculates the car speed correction signal Vce1 required for the actual car speed Vc following-up the car speed command value Vcref. The adder 23 adds the car speed command value Vcref and the car speed correction signal Vce1 and outputs the car speed reference Vcref1. The speed convert circuit 2 inputs the car speed reference Vcref2 which is the value added the vibration compensation signal Vb from the vibration suppress circuit 13 on the car speed reference Vcref1 from the adder 23, and converts to the motor speed reference Vmref, where the car speed reference Vcref2 is expressed as equation (5).

$$Vcref2 = Vcref + Vce1 - Vb \tag{5}$$

The motor speed control circuit 3 makes the actual motor speed Vm follow-up the motor speed reference Vmref by feedback-controlling the motor speed detected value Vmfb detected by the motor speed detecting circuit 5. As a result, the actual motor speed Vm of the elevator mechanical system 4 as the controlled system is controlled and the elevator car travels at the car speed Vc corresponding to the motor speed Vm.

At this point, the filter constant and gain computing circuit 7 selects out the filter constant Tc and the gain Kd from the data table shown in FIG. 2 that are required in order to decrease the influence caused by the changes of the elevator characteristic by using the car load detected value mc and the car position detected value y. The car vibration suppress circuit 8 and the gain setting circuit 11 in the vibration suppress circuit 13 calculate the vibration compensation signal Vb for suppressing the vibration of the elevator by using the car speed reference Vcref2, the car speed detected value Vcfb and the filter constant Tc and the gain Kd selected by the filter constant and gain computing circuit 7. The vibration compensation signal Vb is added on the car speed reference Vcref1 by the adder 24 to gain the car speed reference Vcref2. As s result, the car speed reference Vcref2 from the adder 24 has been compensated by the calculation based on equation (5) for the vibration suppression. This car speed reference Vcref2 is inputted to the speed convert circuit 2.

According to the first embodiment of the speed control apparatus for elevator set forth above, since the filter constant and gain computing circuit 7 selects the filter constant Tc and the gain Kd based on both actual car position and car load, it can select the most pertinent filter constant Tc and the gain Kd to effectively suppress the car vibration whatever largely the car load fluctuates while the car is running at the specific speed range which is sensitive to cause a great vibration thereto.

Hereinbelow, a second embodiment of this invention will be explained. The second embodiment of a speed control apparatus for an elevator is characterized by additionally provided with a noise reduction circuit 12 for reducing noises contained in the car speed detected value Vcfb on the first embodiment shown in FIG. 1.

The noise reduction circuit 12 reduces a high-frequency noise component contained in the car speed detected value Vcfb and outputs a precise car speed signal Vcfb1 to input to the follow-up control circuit 1.

A typical arithmetic equation carried out in this noise reduction circuit 12 is shown by equation (6), where Tf is a regulating parameter defined by a numerical simulation or an analysis of the car speed detected value Vcfb.

$$Vcfb\ 1 = \frac{1}{(1 + Tf \cdot s)^2} \cdot Vcfb \tag{6}$$

This noise reduction circuit 12 can reduce the high-frequency noises contained in the speed reference for the motor in the prior art technique and control the car speed precisely.

Next, a third embodiment of this invention will be explained. The third embodiment of a speed control apparatus for an elevator is characterized by adopting an H∞ control to the follow-up control circuit 1 disclosed in the first embodiment of the speed control apparatus for elevator shown in FIG. 1. The H∞ control by nature includes functions of the vibration suppression and the high-frequency noise reduction, and therefore, the noise reduction circuit 12 adopted by the second embodiment is unnecessary. However, the filter constant and gain computing circuit 7, the car vibration suppress circuit 8 and the gain setting circuit 11 are necessary as the means for compensating the changes of the elevator characteristic. The reason will be explained in the following.

Since the H∞ control models an error contained in a controlled system and pursuits a performance improvement of a target follow-up control within tolerance limits of the error, it is inevitable to lower the performance of the target follow-up control when the controlled system tends to largely fluctuate. In contrast, the elevator characteristic greatly changes in accordance with the changes of the number of passengers and the rope length in the elevator control system. Therefore, it is inevitable to compensate these changes of the elevator characteristic for realizing the required performance of the follow-up control by means of the H∞ control.

In this third embodiment of the speed control apparatus for elevator, a speed control of stable against the changes of the elevator characteristic and efficient in the vibration suppression is realized by firstly compensating the changes of the elevator characteristic like the first embodiment and secondly carrying out the follow-up control by the H∞ control. Here, it is noted that a system design adopting the H∞ control is easy by using application software like 'MATLAB' (Cyber-net System Co. Ltd.).

Figure 5:
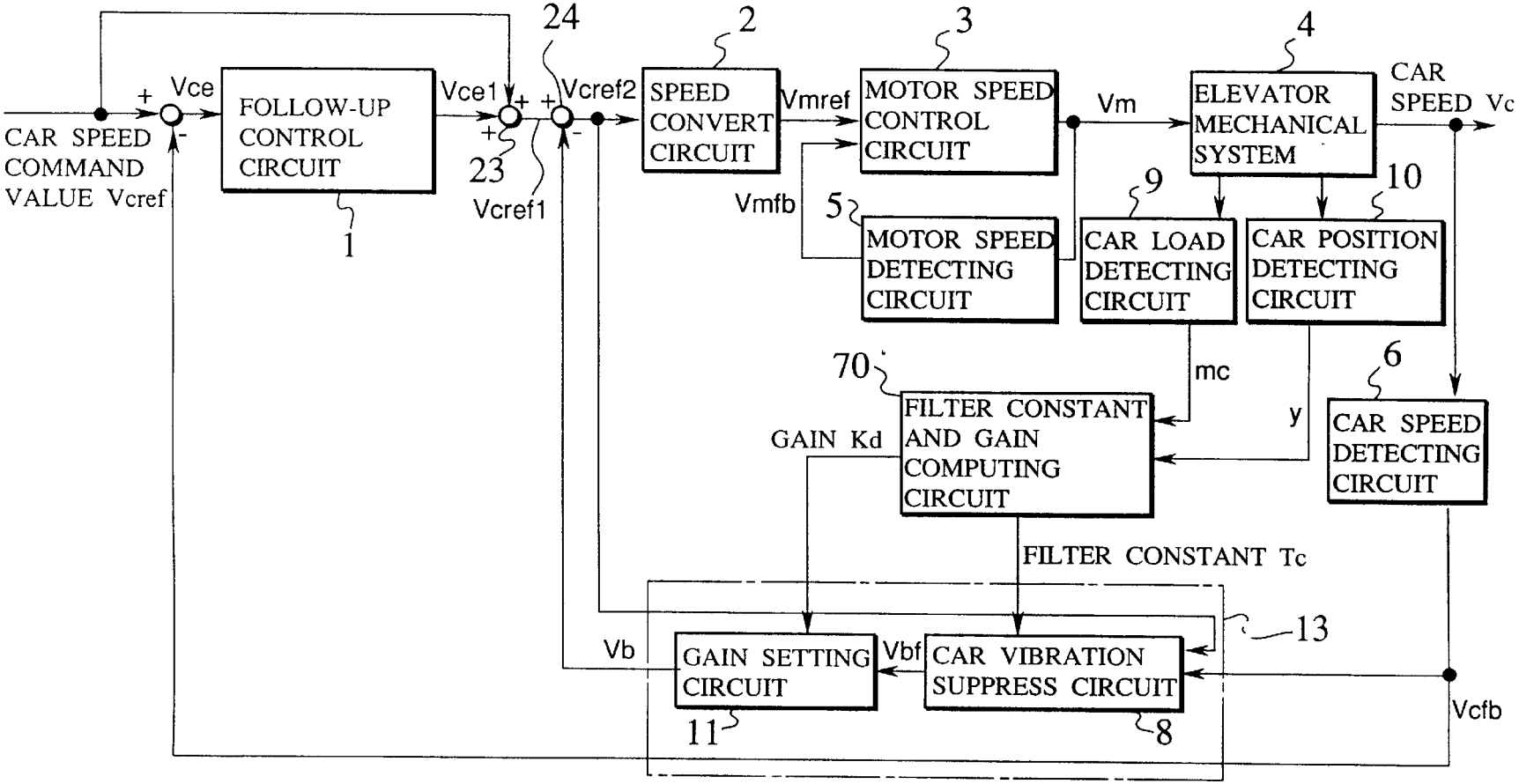
FIG. 5 is a schematic diagram of a fourth embodiment of a speed control apparatus for an elevator of this invention.

Next, a fourth embodiment of this invention will be explained with reference to FIGS. 5 and 6. In the first to third embodiments, the filter constant and gain computing circuit 7 uses the data table as shown in FIG. 2, and selects the filter constant Tc and the gain Kd corresponding to the car load detected value mc from the car load detecting circuit 9 and the car position detected value y from the car position detecting circuit 10 by referring thereto. But the fourth embodiment is characterized by using a filter constant and gain computing circuit 70 instead of the filter constant and gain computing circuit 7. This filter constant and gain computing circuit 70 computes a filter constant Tc and a gain Kd by adopting the car load detected value mc and the car position detected value y as parameters to a function. Here in FIGS. 5, and 6, other elements are the same with that of the first embodiment, and the identical reference numerals are used to the similar elements.

Figure 6:
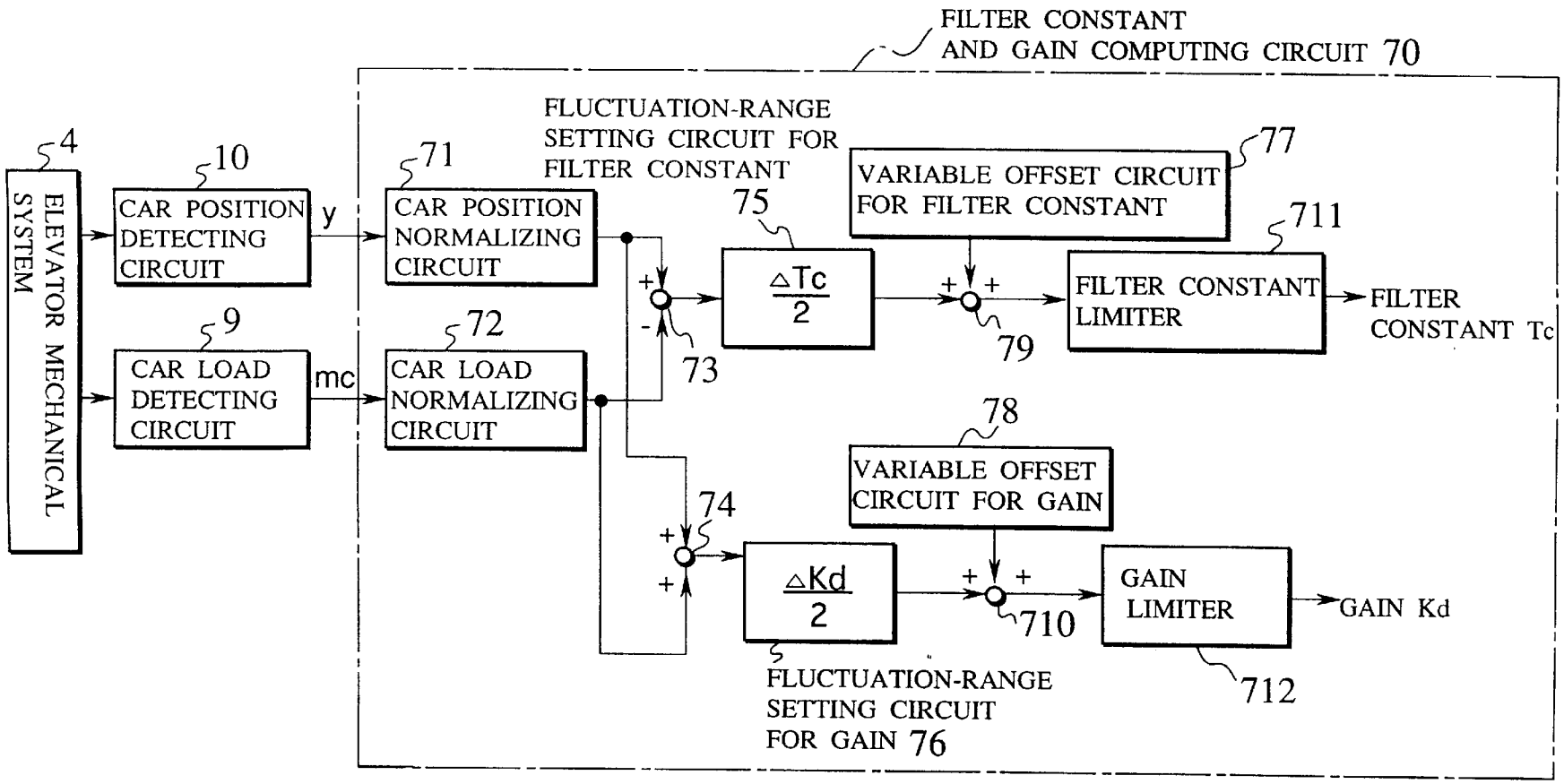
FIG. 6 is a block diagram of a filter constant and gain computing circuit according to the fourth embodiment of this invention.

As shown in FIG. 6, the filter constant and gain computing circuit 70 in this fourth embodiment is provided with a car position normalizing circuit 71, a car load normalizing circuit 72, adders 73 and 74, a fluctuation-range setting circuit for filter constant 75, a fluctuation-range setting circuit for gain 76, a variable offset circuit for filter constant 77, a variable offset circuit for gain 78, adders 79 and 710, a filter constant limiter 711 and a gain limiter 712.

The car position normalizing circuit 71 and the car load normalizing circuit 72 are provided in order to gain absolute numbers by dividing the car position detected value y and the car load detected value mc by their maximum value respectively, so that it makes the adders 73 and 74 able to add the car position detected value y and the car load detected value mc.

The fluctuation-range setting circuit for filter constant 75 and the fluctuation-range setting circuit for gain 76 computes a fluctuation-range ΔTc for the filter constant Tc and a fluctuation-range ΔKd for the gain Kd based on the following equations (7) and (8) respectively and further divides these values by 2. These values ΔTc/2 and ΔKd/2 are to be used for compensation of the filter constant Tc and the gain Kd corresponding to the characteristic changes of the elevator mechanical system 4. In the following equations, Tcmax and Tcmin are the maximum and the minimum values among the filter constants and Kdmax and Kdmin are the maximum and the minimum values among the gains. Further, the reason of the divisions by 2 against the result values from equations (7) and (8) is that, since the values ΔTc and ΔKd as a result of an addition and a subtraction carried out after normalization fluctuate within −2~+2 range, it is necessary to restrict the fluctuation range within −1~+1.

$$\Delta Tc = Tc\ \max - Tc\ \min \tag{7}$$

$$\Delta Kd = Kd\ \max - Kd\ \min \tag{8}$$

The variable offset circuit for filter constant 77 and the variable offset circuit for gain 78 give center values, or offset values Tcoffset and Kdoffset, against the fluctuation-ranges ΔTc/2 and ΔKd/2 from the fluctuation-range setting circuits 75 and 76. These center values are given from a simulation carried out in advance.

The adder 79 outputs to the filter constant limiter 711 a result of an addition of the fluctuation-range ΔTc/2 from the fluctuation-range setting circuit for filter 75 and the center value from the variable offset circuit for filter constant 77. The filter constant limiter 711 limits the result of the addition so as to make the system act within a stable range and prevent a malfunction and a diversion. In the same manner, the adder 710 outputs to the gain limiter 712 a result of an addition of the fluctuation-range ΔKd/2 from the fluctuation-range setting circuit for gain 76 and the center value from the variable offset circuit for gain 78, and the gain limiter 712 limits the result of the addition so as to make the system act within a stable range and prevent a malfunction and a diversion. These stable ranges are to be set by a simulation carried out in advance.

Consequently, the filter constant Tc and the gain Kd computed in the filter constant and gain computing circuit 70 can be expressed by the following equations (9) and (10), where numerals in brackets [ ] are the normalized numerals and numerals in brackets | | are the limited numerals.

$$Tc = \left| \frac{\Delta Tc}{2} \cdot ([y] - [mc]) + Tcoffset \right| \tag{9}$$

$$Kd = \left| \frac{\Delta Kd}{2} \cdot ([y] - [mc]) + Kdoffset \right| \tag{10}$$

As can be seen from equations (9) and (10) and the structure shown in FIG. 6, the filter constant and gain computing circuit 70 treats the car position and the car load as parameters equivalently. Further, the filter constant and gain computing circuit 70 defines the most pertinent filter constant Tc by using the common knowledge that, the higher the car position rises and the lighter the car load decreases, the higher the resonance frequency of the elevator mechanical system 4 rises. Additionally, the circuit 70 defines the gain Kd by using the common knowledge that, the higher the car position rises and the heavier the car load increases, the greater the most pertinent gain for suppressing the vibration increases.

The fourth embodiment of the speed control apparatus for elevator provided with the filter constant and gain computing circuit 70 as set forth above acts in the same manner with the first embodiment shown in FIG. 1. The follow-up control circuit 1 inputs the deviation between the car speed command value Vcref and the car speed detected value Vcfb and calculates the car speed correction value Vce1 which is required in order the actual car speed Vc to follow-up the car speed command value Vcref. The adder 23 adds the car speed command value Vcref and the car speed correction value Vce1 and outputs the car speed reference Vcref1.

The speed convert circuit 2 inputs the car speed reference Vcref2 from the adder 24 which adds the car speed reference Vcref1 and the vibration compensation signal Vb from the vibration suppress circuit 13, and converts the input car speed reference Vcref2 into the motor speed reference Vmref to output to the motor speed control circuit 3. The motor speed control circuit 3 control the motor speed Vm to follow-up the motor speed reference Vmref by feeding-back the motor speed detected value Vmfb from the motor speed detecting circuit 5. Consequently, the motor speed Vm of the elevator mechanical system 4 as the controlled system is controlled and the car of the elevator travels at the speed Vc corresponding to the motor speed Vm.

Here, the filter constant and gain computing circuit 70 carries out the calculation based on the above equations (9) and (10) by using the car load detected value mc and the car position detected value y and outputs to the vibration suppress circuit 13 the filter constant Tc and the gain Kd pertinent for reducing the influence by the characteristic changes of the elevator.

In the vibration suppress circuit 13 inputted the filter constant Tc and the gain Kd from the filter constant and gain computing circuit 70, in the same manner with the first embodiment, the car vibration suppress circuit 8 and the gain setting circuit 11 calculate the vibration compensation signal Vb for suppressing the vibration of the elevator by using the car speed reference Vcref2, the car speed detected value Vcfb, the filter constant Tc and the gain Kd. The adder 24 adds the vibration compensation signal Vb on the car speed reference Vcref1 so as to gain the car speed reference Vcref2 which has been compensated for the vibration suppression based on equation (5), and this car speed reference Vcref2 is inputted to the speed convert circuit 2.

Accordingly, in this speed control apparatus for elevator of the fourth embodiment, since the filter constant and gain computing circuit 70 refers to both the car position and the car load in the calculations of the filter constant Tc and the gain Kd, it can define the most pertinent filter constant Tc and gain Kd to effectively suppress the vibration of the car, whatever large fluctuation of the car load occurs while running at the specific speed range wherein the great vibration tends to occur.

In addition, the following features that are different from the first embodiment reside in the fourth embodiment. In the first embodiment, since the filter constant Tc and the gain Kd corresponding to the combination of the car position detected value y and the car load detected value mc are selected from a predetermined data table like that as shown in FIG. 2 by the filter constant and gain computing circuit 7, when a higher precision is required, it is inevitable that the amount of data to be registered to the data table tends to greatly increase so that the required memory capacity in the system greately increases.

As for the fourth embodiment, in contrast, as the filter constant and gain computing circuit 70 computes the filter constant Tc and the gain Kd by adopting the car position detected value y and the car load detected value y as the parameters to equations (9) and (10), the necessity of increasing the memory capacity is not required for the higher precision.

Figure 7:
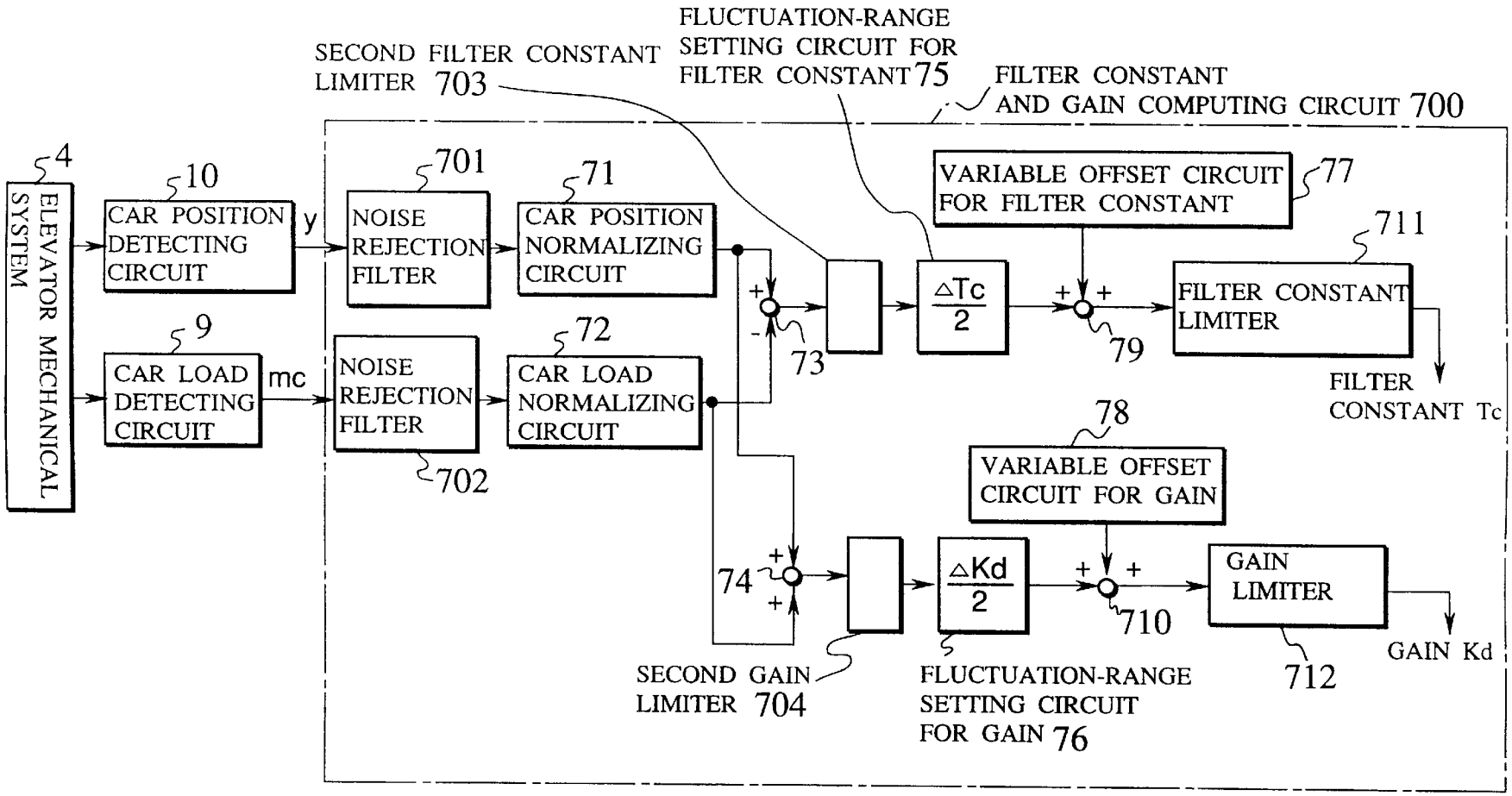
FIG. 7 is a block diagram of a filter constant and gain computing circuit in a fifth embodiment of this invention.
Figure 8:
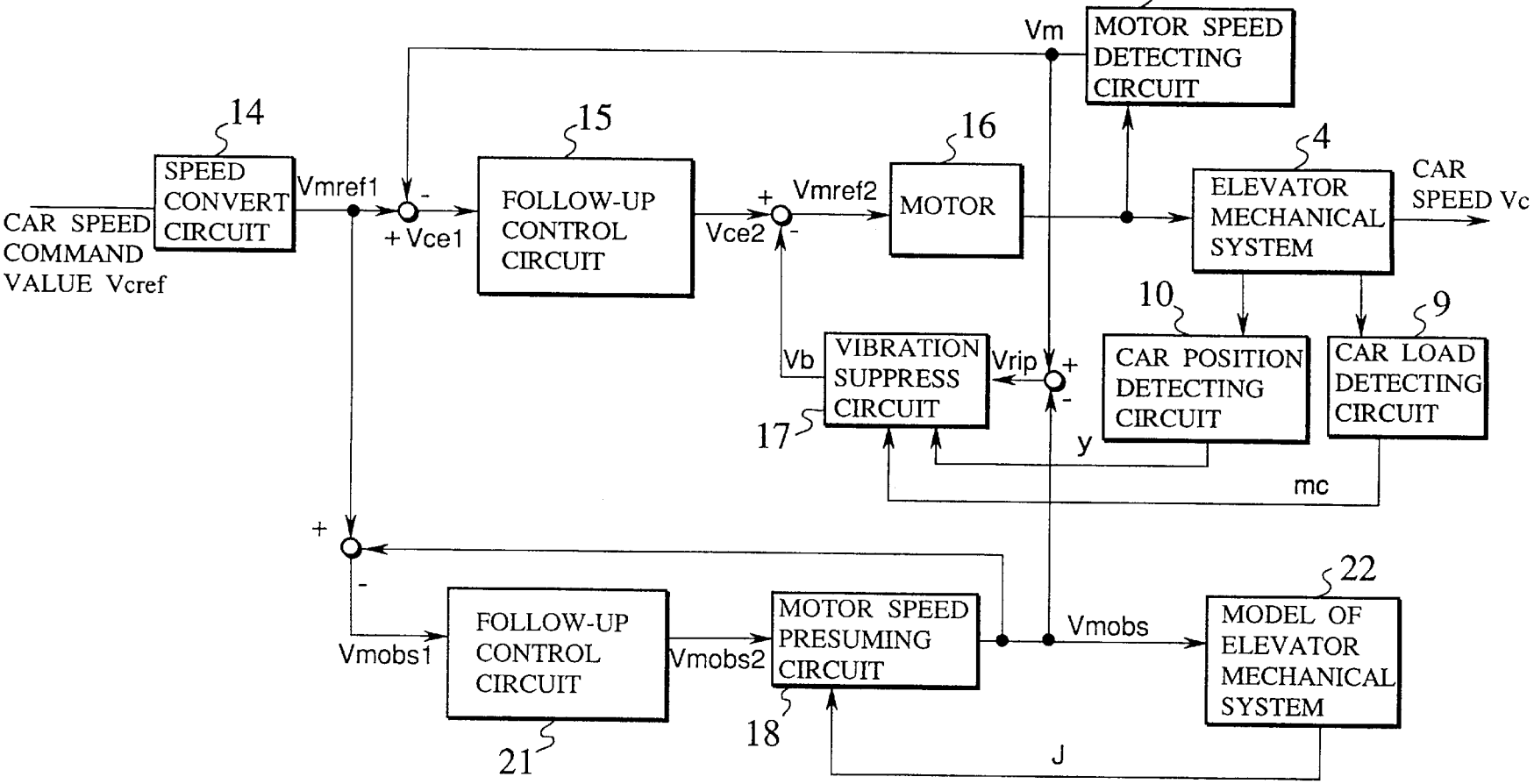
FIG. 8 is a schematic diagram showing the prior art arrangement.
Figure 9:
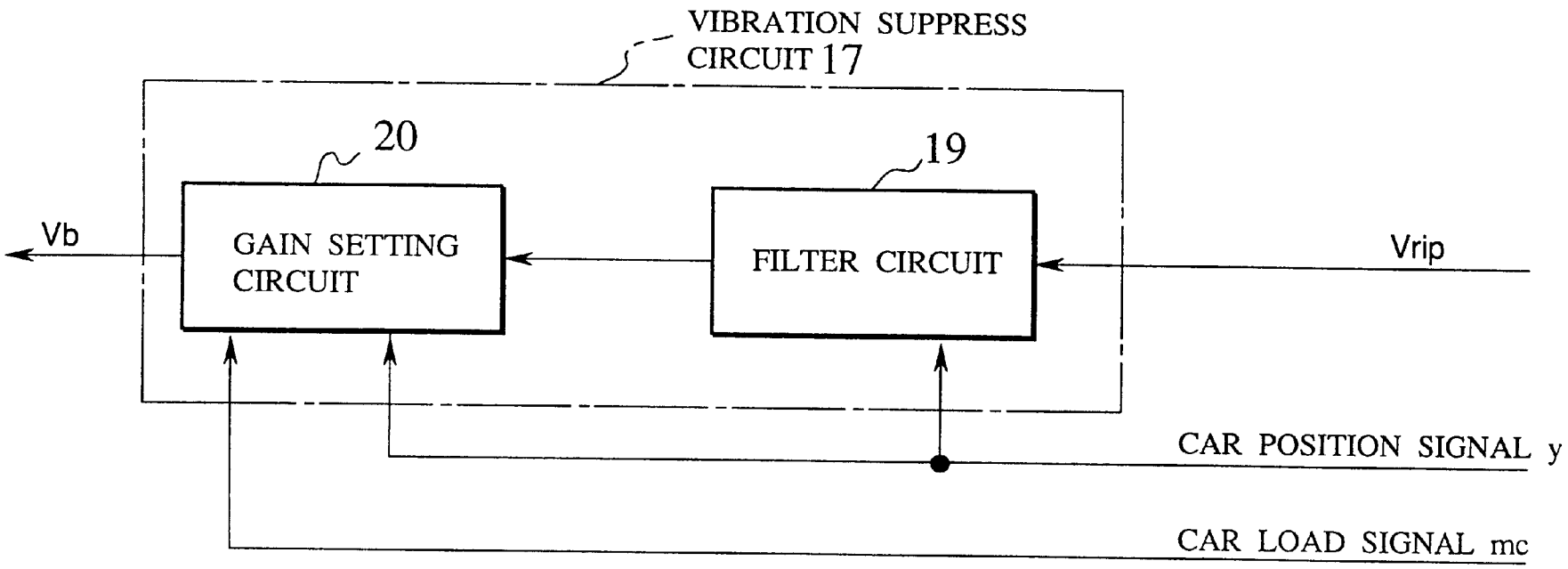
FIG. 9 is a block diagram of a vibration suppress circuit in the prior art arrangement.
Figure 10:
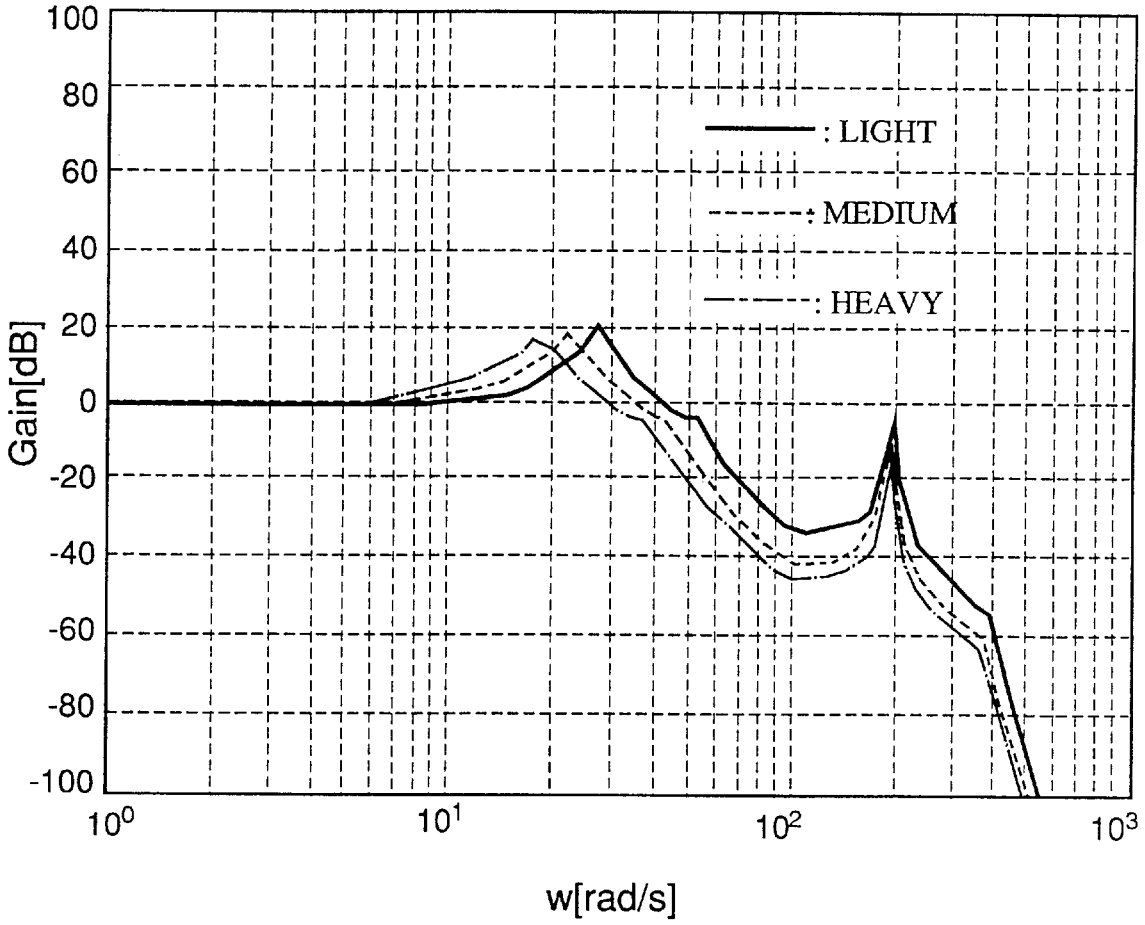
FIG. 10 is a graph showing a vibration frequency characteristic depending on car loads of an elevator.

Next, a fifth embodiment of this invention will be explained with reference to FIG. 7. In the fifth embodiment of a speed control apparatus for an elevator, a filter constant and gain computing circuit 700 as shown in FIG. 7 is provided instead of the filter constant and gain computing circuit 70 shown in FIG. 5. Compared to the filter constant and gain computing circuit 70 of the fourth embodiment shown in FIG. 6, this filter constant and gain computing circuit 700 features that it is additionally provided with noise rejection filters 701 and 702, a second filter constant limiter 703 and a second gain limiter 704.

The filters 701 and 702 reside for rejecting noises contained in the car position detected signal and the car load detected signal. The noise rejection filter 701 outputs a noise-free signal y1 by using equation (11), and also the noise rejection filter 702 calculates by using a similar equation, where, in equation (11), Tn is a regulating parameter, and defined based on the detected value.

$$y1 = \frac{1}{1 + Tn \cdot s} \cdot y \tag{11}$$

These noise rejection filters 701 and 702 can prevent a malfunction caused by surges riding on the detected values and realize an efficient compensation against the characteristic changes.

The second filter constant limiter 703 and the second gain limiter 704 limit over the result of the ladders 73 and 74 so as to prevent a malfunction caused by excessive fluctuations over permissive fluctuation-ranges (the lower limits of the permissive fluctuation-ranges are −2 and the upper limits thereof are +2 respectively as the car position detected value and the car load detected value both have passed through the normalizing circuits 71 and 72). These second limiters 703 and 704 together with the final limiters 711 and 712 restrict results of calculations and doubly prevent the malfunction.

Consequently, in the fifth embodiment, the filter constant Tc and the gain Kd computed by the filter constant and gain computing circuit 700 can be expressed by the following equations (12) and (13), where numerals in brackets < > are the filtered numerals and numerals in brackets [ ] are the normalized numerals and numerals in brackets | 51 are the limited numerals.

$$Tc = \left| \frac{\Delta Tc}{2} \cdot ([\langle y \rangle] - [\langle mc \rangle]) + Tcoffset \right| \tag{12}$$

$$Kd = \left| \frac{\Delta Kd}{2} \cdot ([\langle y \rangle] - [\langle mc \rangle]) + Kdoffset \right| \tag{13}$$

Hereinbefore, the speed control apparatus for the roped-elevator has been explained as the embodiment of this invention, the technical idea of this invention is applicable to a speed control apparatus for a valve control type hydraulic elevator, an inverter control type hydraulic elevator, a stage apparatus and other various typed elevators.

INDUSTRIAL APPLICABILITY

As set forth above, this invention of the speed control apparatus for elevator can precisely control the travel speed of the car withstanding the influence of the resonance in the mechanical system ogenerated at the specific frequency that changes according to the changes of the car position and load so that the passenger comfort is greatly improved.

I claim:

1. A speed control apparatus for an elevator comprising:

a car speed detecting circuit for detecting a car speed;

a car load detecting circuit for detecting a car load;

a car position detecting circuit for detecting a car position;

a car speed feedback control circuit for inputting a deviation between a car speed command value input thereto and a car speed detected value from the car speed detecting circuit and for calculating a car speed correction signal required for an actual car speed to follow-up the car speed command value;

a speed convert circuit for converting the car speed correction signal calculated by the car speed feedback control circuit into a motor speed reference signal of the elevator;

a motor speed control circuit for controlling a speed of a motor which drives the elevator based on the motor speed reference signal outputted from the speed convert circuit; and a vibration component compensation circuit for eliminating from the car speed detected value a resonance frequency component of an elevator mechanical system corresponding to a combination of the car load detected value from the car load detecting circuit and the car position detected value from the car position detecting circuit and for outputting the resonance frequency component as a vibration compensation signal to suppress the resonance frequency component contained in the car speed correction signal, wherein the vibration component compensation circuit includes a filter constant and gain calculating circuit for calculating a filter constant corresponding to the combination of the car load detected value from the car load detecting circuit and the car position detected value from the car position detecting circuit, and for calculating a gain corresponding to the combination of the car load detected value from the car load detecting circuit and the car position detected value from the car position detecting circuit.

2. A speed control apparatus for an elevator according to the claim 1, wherein the car speed detecting circuit includes a high frequency noise filter for reducing a high frequency noise contained in the car speed detected value.

3. A speed control apparatus for an elevator according to claim 1, wherein the vibration component compensation circuit further includes:

a filter for setting a pass frequency based on the filter constant from the filter constant and gain calculating circuit and for passing the resonance frequency component of the elevator mechanical system contained in the car speed detected value; and a gain setting circuit for multiplying the resonance frequency component of the elevator mechanical system outputted from the filter by the gain from the filter constant and gain calculating circuit and for outputting a result thereof as the vibration compensation signal to suppress the resonance frequency component contained in the car speed correction signal.

4. A speed control apparatus for an elevator according to the claim 3, wherein the filter constant and gain calculating circuit includes a data table for selecting the filter constant and the gain corresponding to the combination of the car position detected value and the car load detected value.

5. A speed control apparatus for an elevator according to the claim 3, wherein the filter constant and gain calculating circuit carries out a calculation based on an arithmetic equation treating the car position detected value and the car load detected value as parameters.

6. A speed control apparatus for an elevator according to claim 5, wherein the filter constant and gain calculating circuit includes:

a car position normalizing circuit for normalizing the car position detected value;

a car load normalizing circuit for normalizing the car load detected value;

a first setting circuit for setting a fluctuation-range of the filter constant by setting the fluctuation-range of the filter constant based on a predetermined maximum value and a predetermined minimum value and by multiplying a deviation between outputted values from the car position normalizing circuit and the car load normalizing circuit by the fluctuation-range of the filter constant;

an adder for the filter constant for adding a predetermined offset of an output from the first setting circuit and for outputting a result as the filter constant;

a second setting circuit for setting a fluctuation-range of the gain by setting the fluctuation-range of the gain based on a predetermined maximum value and a predetermined minimum value and by multiplying the deviation between outputted values from the car position normalizing circuit and the car load normalizing circuit by the fluctuation-range of the gain; and an adder for the gain for adding a predetermined offset on an output from the second setting circuit and for outputting a result as the gain.

7. A speed control apparatus for an elevator according to claim 5, wherein the filter constant and gain calculating circuit includes:

a car position normalizing circuit for normalizing the car position detected value;

a car load normalizing circuit for normalizing the car load detected value;

a first setting circuit for setting a fluctuation-range of the filter constant by setting the fluctuation-range of the filter constant based on a predetermined maximum value and a predetermined minimum value and by multiplying a deviation between outputted values from the car position normalizing circuit and the car load normalizing circuit by the fluctuation-range of the filter constant;

an adder for the filter constant for adding a predetermined offset of an output from the first setting circuit and for outputting a result as the filter constant;

a filter constant limiter for limiting the filter constant outputted from the adder for the filter constant in order to prevent a malfunction;

a second setting circuit for setting a fluctuation-range of the gain by setting the fluctuation-range of the gain based on a predetermined maximum value and a predetermined minimum value and by multiplying the deviation between outputted values from the car position normalizing circuit and the car load normalizing circuit by the fluctuation-range of the gain;

an adder for the gain for adding a predetermined offset on an output from the second setting circuit and for outputting a result as the gain; and a gain limiter for limiting the gain outputted from the adder for the gain in order to prevent a malfunction.

8. A speed control apparatus for an elevator according to the claim 3, wherein the follow-up control circuit carries out an H∞ control.

9. A speed control apparatus for an elevator according to claim 2, wherein the vibration component compensation circuit further includes:

a filter for setting a pass frequency based on the filter constant from the filter constant and gain calculating circuit and for passing the resonance frequency component of the elevator mechanical system contained in the car speed detected value; and a gain setting circuit for multiplying the resonance frequency component of the elevator mechanical system outputted from the filter by the gain from the filter constant and gain calculating circuit and for outputting a result thereof as the vibration compensation signal to suppress the resonance frequency component contained in the car speed correction signal.

10. A speed control apparatus for an elevator according to claim 1, wherein the filter has a filter characteristic according to $s/(1+T^*s)^2$, wherein T is the filter constant and s is a Laplace transform parameter.

11. A speed control apparatus for an elevator according to claim 10, wherein the gain setting circuit has a gain value k, wherein a combination of the filter and the gain setting circuit provide the following transfer characteristic:

$$k^*s/(1+T^*s)^2.$$

* * * * *